United States Patent [19]

Kramer

[11] 4,208,836

[45] Jun. 24, 1980

[54] JARDINIERE AND METHOD OF MAKING SAME

[76] Inventor: Siegfried Kramer, 227 Alabama Ave., Sebring, Ohio 44672

[21] Appl. No.: 708,293

[22] Filed: Jul. 26, 1976

[51] Int. Cl.[2] ..... A47G 7/00

[52] U.S. Cl. ..... 47/72; 264/58

[58] Field of Search ..... 47/66, 72, 71, 79, 80, 47/81; 264/57, 58; 206/520; D11/152, 153, 155

[56] References Cited

U.S. PATENT DOCUMENTS

| | | | |
|---|---|---|---|
| 1,882,046 | 10/1932 | Storey | 264/58 X |
| 2,173,107 | 9/1939 | Gould | 264/58 X |
| 2,206,694 | 7/1940 | Greene | 47/71 |
| 2,788,561 | 4/1957 | Mueller | 264/57 |
| 2,802,304 | 8/1957 | Hille | 47/66 |
| 2,814,911 | 12/1957 | Shep | 47/80 |
| 2,884,741 | 5/1959 | Lange | 47/72 |
| 3,838,772 | 10/1974 | Lang et al. | 206/520 |

FOREIGN PATENT DOCUMENTS

| | | | |
|---|---|---|---|
| 70635 | 2/1950 | Denmark | 264/58 |
| 699880 | 12/1940 | Fed. Rep. of Germany | 47/80 |
| 839136 | 5/1952 | Fed. Rep. of Germany | 47/72 |
| 1263364 | 5/1961 | France | 47/80 |
| 42700 | 3/1938 | Netherlands | 47/80 |
| 366173 | 2/1932 | United Kingdom | 47/80 |

*Primary Examiner*—Paul T. Sewell
*Assistant Examiner*—Steven A. Bratlie
*Attorney, Agent, or Firm*—Albert L. Ely, Jr.

[57] ABSTRACT

Glazed ceramic jardiniere with raised integral portions on the interior of its bottom section providing stable support for and drainage from a flower pot to be enclosed therein, the upper edges of said support being unglazed, and a method of making the same comprising positioning unglazed vitreous supporting members after applying glaze to the ware and then firing said ware after stacking with other such ware.

7 Claims, 5 Drawing Figures

JARDINIERE AND METHOD OF MAKING SAME

This invention relates to an improved glazed ceramic jardiniere or "planter" having integral internal supports allowing drainage from a conventional earthenware flower pot, provided with a central bottom drainage hole and for which the jardiniere is intended to be used as a decorative outer container; the invention also relates to an economical method of manufacturing such glazed jardinieres having integral internal supports.

Particularly for long-lasting "house plants" or growing flowers planted in conventional porous earthenware pots, decorative ceramic jardinieres have long been used as the outer containers for the relatively unsightly pots in which the plants or flowers are grown. If such potted plants are to fluorish, it has also long been recognized that they should not be overwatered and, thus, the bottom of the flower pot should be raised above the inside bottom surface of the jardiniere to allow drainage of excess water through the central drainhole in the flower pot. Also, it is preferable to provide some spacing between the outside wall of the pot and the inside wall of the jardiniere; this allows evaporation of excess water drained into the jardiniere and, at least for those plants which should be well but not excessively watered, such wall spacing allows ready inspection to determine, without removing the often heavy and large plant and pot, the amount of water, if any, remaining in the jardiniere below the pot and, thus, if re-watering is necessary.

Heretofore, the above requisite bottom spacing in jardinieres, selected to be large enough to provide some sidewall spacing, has been most commonly obtained by simply scattering shards of broken flower pots, gravel, etc., onto the bottom of the jardinieres before placing the pot in it. The pot is then usually unstable in the jardiniere unless the pot is twisted and turned until the bottom-supporting pieces are sufficiently shifted to provide stability; this, unfortunately, frequency results in compaction and loss of adequate space into which excess water should be drained. An alternative has been to employ, as separate items to be sold with the jardinieres, grills of metal or plastic upon which the pot may be placed; since jardinieres must be made in a variety of sizes to accommodate the various size of flower pots, such grills must also be in a variety of sizes and present stocking and inventory problems both for the manufacturer of the jardinieres and the retailers of the plants through whom the jardinieres are usually sold. The concept of providing integral spacing elements on the inside bottom section of a jardiniere, which this invention achieves, was heretofore impractical, not merely because of the relatively complex dies and molds required but also because of uneconomic production costs.

An object and advantage of this invention, therefore, is that it provide a ceramic jardiniere having a stable integral support for a flower pot and also having ample drainage space therefor. Another object and advantage of this invention is that it may be produced economically by adaption and modification of otherwise standard techniques and equipment and with a minimum, if any, of special molds or dies. The ceramic jardinieres produced hereby may be decorated and, for all practical purposes of the user, are fully glazed and, thus, readily cleaned and attractive; the small unglazed areas due to the manufacturing process are immaterial so far as use of such jardiniere is concerned.

Other objects and advantages of this invention will be apparent from the following specification, claims, and drawings, in which:

Figure 1:
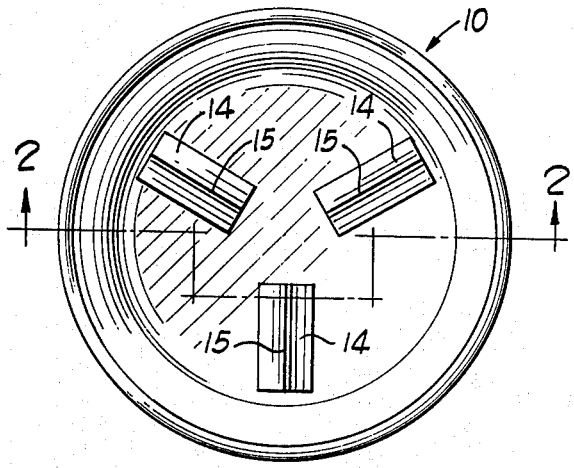
FIG. 1 is a top plan view of a jardiniere made according to this invention.
Figure 2:
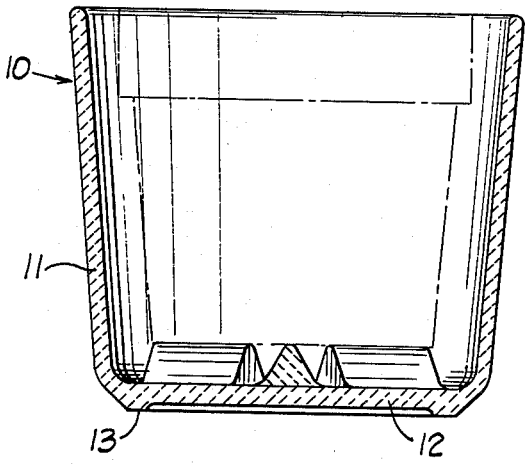
FIG. 2 is a cross-section taken along the line 2—2 of FIG. 1 and showing in phantom, a conventional earthenware flower pot.
Figure 3:
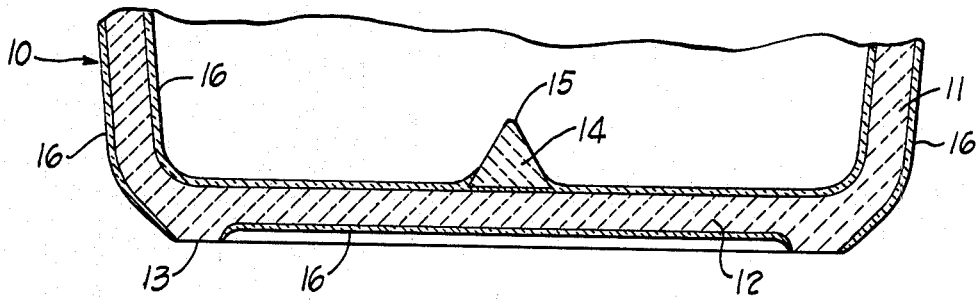
FIG. 3 is a detail of the bottom portion of the jardiniere shown in FIG. 2, but enlarged to show the location of glaze on the article.

Referring to FIGS. 1 to 3 showing a preferred embodiment of this invention, the jardiniere 10 is comprised of a wall portion 11 merging into a bottom section 12 having a conventional circular foot 13. The wall portion 11, except where it merges into the bottom section 12 and foot 13, is shown as conical in shape, one of the simplest configurations to form on conventional jiggering machines. Manifestly, the wall is not confined to this shape of a cone with straight line elements, but may be bulged or provided with re-entrantly curved portions permitted within the limits of conventional jiggering molds and tools. Nor is the production of jardinieres 10 confined to shapes obtainable by the economical jiggering process but may be formed by casting, turning, or wet or dry pressing, if the desired contour of the wall 11 makes one of such other shaping processes preferable.

Once a jardiniere consisting of the wall portion 11 and bottom section 12 has been formed, it may, if formed from an appropriate clay body for chinaware, be subjected to drying and a bisque fire before application of the wet blaze. For economy of production, however, the formed article is usually of the semi-vitreous or glazed earthenware type, i.e., subjected to a single firing after application of underglaze decoration, glazing, and overglaze decoration (if any) and wiping away of unfired glaze where glaze may not be desired, as on the foot, for example; in such single-fire ware, the clay body, glaze, and decoration all become vitrified in one passage through the kiln, as contrasted with the bisque, glost, and "dec" (decoration) multiple firings required for chinaware.

Referring to FIGS. 1 to 3 for the structure of an article made according to this invention, it will be noted that the inside surface of the bottom section 12 supports three substantially equi-angularly located spacers 14. Each such spacer 14 is a prism having a triangular cross-section, with its apex 15 extending substantially radially toward the wall 11. The flat base of a spacer 14 extends toward the center of the bottom 12 from about as close to the wall 11 as permitted by the small internal fillet at the juncture of the wall 11 and the bottom section 12. A conventional flower pot whose foot was equal to or only slightly greater than the inside diameter of a circle tangent to the ends of the spacers 14 extending inwardly from the wall 11 at the level of the apices 15 would be greatly out of proportion to the size of jardiniere 10 and, thus, unlikely to be used in it. To accommodate such minimum likely sizes of flower pots, the adjacent end-faces of the spacers 14 may be configured so as to meet at the center of the bottom section 12 and form a three-pointed star, but for all practical purposes the radial length of the spacers 14 need be only about from three-quarters to one-half of the inside radius of the bottom section 12 to accommodate and provide a stable support for the foot of any conventional flower pot for which the size of the jardiniere would be proportional and likely to be used.

Structurally, and referring to FIG. 3 particularly, it is to be noted that both the inside and outside of the wall 11 and the bottom section 12 are covered with a fired glaze 16, but both the foot 13 and at least the apex 15 are free of such glaze. Further, the spacers 14 are secured to and made integral with the bottom section 12 by an intermediate layer of glaze and also a meniscus of glaze extending partly up the sides of the spacers 14. The cause of this meniscus and the absence of glaze 16 at the apex 15 and on the foot 13 and the purpose thereof is explained in the following description of a method of making the above described jardiniere 10.

To make the above described jardiniere 10, one is shaped as desired, preferably by a jiggering machine. When dried (if formed from a wet plastic clay or cast from a slip) or if dry (because it has been formed by dry-pressing or has been subjected to a bisque fire), a wet glaze comprised of a slurry of water and frit is applied to all surfaces of the jardiniere walls and bottom sections by dipping or by an automatic glazing machine. If the ware is to be provided with underglaze decorations, such decoration is applied before glazing. After the wet unfired glaze has been dried, any overglaze decoration is applied and the spacers 14 are positioned on the dried unfired glaze on the inside of the bottom section 12. The spacers 14 are preferably short lengths of a fully vitrified rod or pin known as a "sagger pin". Such pins, extruded from a refractory clay body and then fired, are commonly used to support ware in saggers (refractory frames or cases) in which chinaware is fired. Either before or after placing the spacers 14 within one jardiniere body, the foot 13 is wiped with a sponge to remove any unfired glaze on it.

Figure 4:
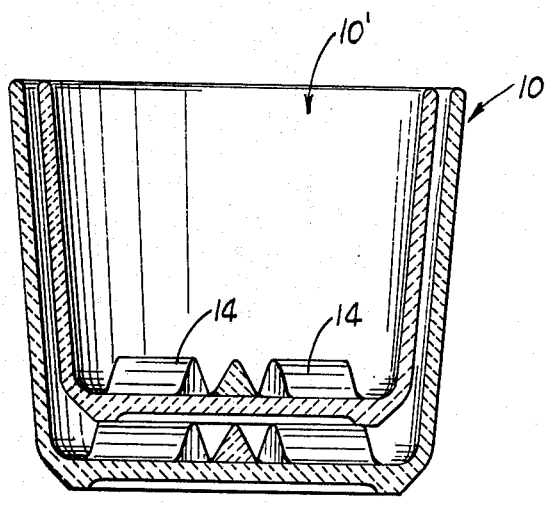
FIG. 4 is a cross-section showing the commencement of a stacking of jardinieres for firing according to this invention.

If the angularity of the sidewalls 11 and height of the spacers 14 permit, several jardinieres 10 of the same dimension, with the unfired glaze applied and the spacers 14 positioned, are then stacked to the height permitted by the kiln. If such stacking cannot be accomplished, in any event plants producing such jardinieres require a range of sizes of them and, thus, a smaller size jardiniere 10' is stacked in a larger jardiniere 10, as shown in FIG. 4. It is not uncommon for as many as four or more to be combined in a stack, the commencement of which is shown in FIG. 4.

The stacks of assembled jardinieres are then placed in a kiln and fired at the temperatures and for the time required by the ware. During the fire, the frit in the glazes fuses and, as a very viscous liquid, is slightly squeezed out from under the bases of the spacers 14, due to the weight of ware supported by the apices 15 in the stack or of a spacer itself, thereby accounting for the meniscuses at the bases of the spacers 14. The stacking of the jardinieres during the firing of the glaze makes maximum utilization of the kiln's capacity, production rate, and fuel consumption per piece. Ready separation of the articles after cooling is due to the fact that the only contact between the articles during the fire has been between the "dry" foot 13 and the "dry" apices 15 of the spacers 14. If a foot 13 has not been sufficiently wiped so that some of the fusing glaze 16 creeps to an apex 15, a sharp tap separates two adjacent stacked jardinieres and any roughness on a foot is easily removed by grinding.

Figure 5:
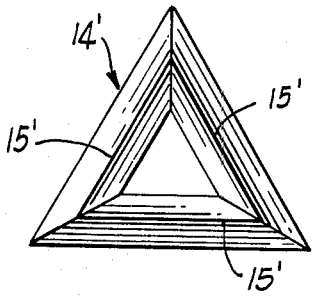
FIG. 5 is a plan view of an example of a variation of the spacers shown in FIGS. 1 to 4.

The invention may be modified from the preferred embodiment disclosed above. Thus, the spacing elements need not be radially disposed and may be more than three in number, though spacers providing three lines or points of contact will usually provide a more stable support for a flower pot contained in the jardiniere. For example, particularly for flower pots which have a circumferential foot in addition to a central drainage hole, a single delta 14' having apices 15', as shown in FIG. 5, may be a satisfactory spacer if the points of the delta approach the sidewalls 11. The foot of the pot will rest on and overhang the edges of the apices 15' and allow water to drain over the apices to the outside of the pot. Still other variations and embodiments may be made without departing from the scope of the following claims.

What is clamed is:

1. A ceramic jardiniere comprising an integral sidewall and bottom section and flower pot supporting means providing at least three spaced edges raised above and integral with said bottom section, one of said edges being located on one side of a diameter bisecting said bottom section and at least one of the other of said edges having points located on the opposite side of said diameter, said walls and bottom section are glazed, said bottom section having an unglazed foot, the spaced edges of said supporting means being glaze-free, and said supporting means being of a vitrified ceramic material and made integral with the upper surface of said bottom section by a vitrified glaze fused to said bottom section and said support means.

2. A jardiniere as defined in claim 1 in which said support means is triangular in cross-section and the base thereof is parallel to said bottom section.

3. A jardiniere as defined in claim 2 in which said support means is comprised of three membes.

4. A jardiniere as defined in claim 3 in which the apex of each member of said support means extends substantially radially of the center of the bottom section.

5. A method of making a substantially fully glazed ceramic jardiniere of the class described comprising the steps of forming the ware with an integral wall and a footed bottom section, glazing the surface of the same with a wet glaze, positioning, upon unfired glaze on the bottom section, a flower pot supporting means of unglazed vitrified ceramic material, and then firing the ware to fuse the glaze and bond said supporting means to the upper surface of said bottom section.

6. The method as defined in claim 5 including the step of wiping the foot of said bottom section substantially free of unfused glaze before firing said ware.

7. The method as defined in claim 6 including the step, prior to firing said ware, of stacking a plurality of jardinieres made according to claim 6 so that the glaze-free foot of one jardiniere rests on the unglazed supporting means of the next lower jardiniere in such stack.

* * * * *